US007479593B1

(12) United States Patent
Townsend

(10) Patent No.: US 7,479,593 B1
(45) Date of Patent: Jan. 20, 2009

(54) QUICK RELEASE CYMBAL LOCKING DEVICE

(76) Inventor: David J. Townsend, 5400 Rio Vista St., Sarasota, FL (US) 34243

( * ) Notice: Subject to any disclaimer, the term of this patent is extended or adjusted under 35 U.S.C. 154(b) by 0 days.

(21) Appl. No.: 11/986,051

(22) Filed: Nov. 19, 2007

(51) Int. Cl.
*G10D 13/02* (2006.01)

(52) U.S. Cl. ..... 84/421; 411/437; 248/635

(58) Field of Classification Search ..... 84/421; 411/437; 248/635
See application file for complete search history.

(56) References Cited

U.S. PATENT DOCUMENTS

| | | | | |
|---|---|---|---|---|
| 2,118,361 | A | 5/1938 | Schaeffer, Jr. | |
| 3,336,827 | A * | 8/1967 | Gaylor | 84/422.3 |
| 3,994,198 | A * | 11/1976 | Herman | 84/421 |
| 4,216,695 | A | 8/1980 | Hoshino | |
| 4,319,514 | A * | 3/1982 | Donohoe | 84/421 |
| 4,365,535 | A | 12/1982 | Buttner et al. | |
| 4,369,012 | A * | 1/1983 | Bailet et al. | 411/437 |
| 4,960,028 | A * | 10/1990 | Ramirez | 84/421 |
| 5,152,651 | A * | 10/1992 | Arteon | 411/433 |
| 5,668,332 | A | 9/1997 | Lombardi | |
| 5,775,863 | A * | 7/1998 | Anderson | 411/512 |
| 5,934,629 | A * | 8/1999 | Peritz | 248/177.1 |
| 6,177,621 | B1 * | 1/2001 | Hoshino | 84/422.3 |
| 6,930,233 | B2 | 8/2005 | Hsieh | |
| 7,176,368 | B2 | 2/2007 | Takegawa | |
| 7,395,994 | B1 * | 7/2008 | Sikra | 248/229.1 |

* cited by examiner

*Primary Examiner*—Walter Benson
*Assistant Examiner*—Robert W Horn
(74) *Attorney, Agent, or Firm*—Charles J. Prescott

(57) ABSTRACT

In a cymbal mounting arrangement including a cymbal rod having a threaded distal end for receiving and supporting a cymbal thereover, an improvement including a quick-release locking device for retaining the cymbal on the rod. The locking device includes an elongated body having a longitudinal bore formed therethrough sized for close slidable engagement over the distal end of the cymbal rod. The locking device also includes a spring biased release arm pivotally connected within a cavity formed into the side of the body about a transverse pivot axis. The release arm is configured having thread-engaging teeth at a proximal end thereof which biasingly engage against a limited number of threads of the distal end of the cymbal rod. An upper distal end of the release arm, when pivoted toward said body, releases the teeth from engagement with the threads of the distal end of the cymbal rod, allowing the locking device to be repositioned along the distal end of the cymbal rod or removed therefrom.

3 Claims, 3 Drawing Sheets

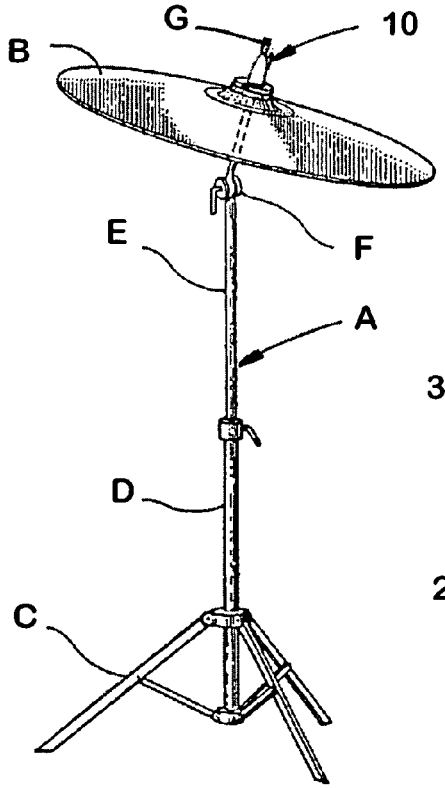
FIG 1
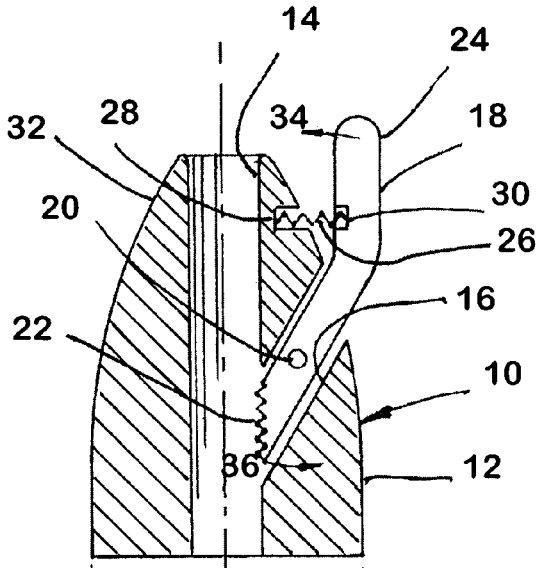
FIG 2
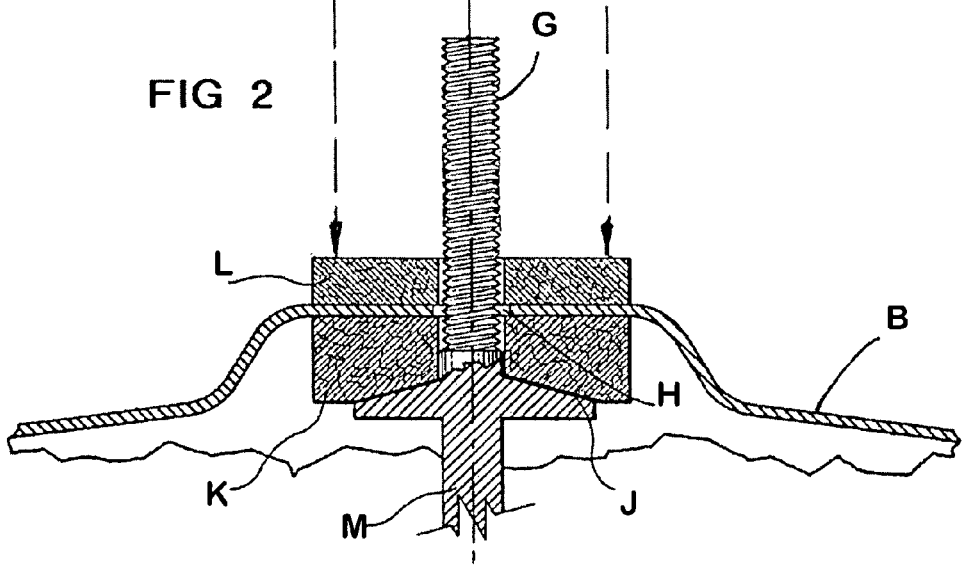

QUICK RELEASE CYMBAL LOCKING DEVICE

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to quick release clamps and more particularly to a quick release locking device for a cymbal mounting arrangement which enables the cymbal to be quickly changed during and between musical performances.

2. Description of Related Art

Musicians routinely use cymbals to enhance a musical performance. A typical prior art cymbal arrangement is depicted in FIG. 5 of U.S. Pat. No. 6,930,233 (incorporated herein by reference) which also discloses a fast release clamp in lieu of a thumb screw for holding a cymbal in place and for quick interchangeability of cymbal sizes.

The purpose for the present invention is to quickly complete the necessary interchangeability of cymbal sizes to achieve various musical effects. However, during a musical performance, little time is provided for the quick interchange of cymbals and therefore an effective locking device for holding the cymbal in place while still facilitating the almost momentary interchangeability of cymbals is required.

A number of prior art devices have addressed this issue, some successfully, none of which have achieved market acceptance or success. U.S. Pat. No. 3,994,198 to Herman discloses a cymbal retainer in the form of a one-piece nylon plastic device for screwing on a cymbal rod. A quick release nut assembly for percussion instrument is taught in U.S. Pat. No. 7,176,368 to Takegawa. First and second wing members provide a locking position wherein the main body is immovably locked to the threaded shaft.

Lombardi discloses a cymbal position control apparatus in U.S. Pat. No. 5,668,332 and Donohoe teaches a mounting device for a cymbal having a quick release arrangement in U.S. Pat. No. 4,319,514.

Another quick-release cymbal mounting fastener is taught by Ramirez in U.S. Pat. No. 4,960,028. The quick-disconnect fastener is actuated by squeezing the tabs together to force the sleeve members apart. Hsieh teaches a fast release cymbal clamp with a handle pivotally connected to the assembly block in U.S. Pat. No. 6,930,233.

A one-piece reversible fastener for mounting cymbals to stands is taught in U.S. Pat. No. 4,216,695 to Hoshino and Buttner, et al. teaches a quick release locking mechanism for use as a cymbal retainer in U.S. Pat. No. 4,365,535. A quick action nut is disclosed in U.S. Pat. No. 2,118,361 to Schaeffer, Jr.

The present invention discloses an improvement for a cymbal mounting arrangement teaching a unique quick release locking device for retaining the cymbal on the threaded distal end of the cymbal rod. Both economy and ease of manufacture are greatly facilitated by the present disclosure which is expected to receive wide market acceptability for those musicians who routinely deal with this challenge of cymbal interchangeability during and between musical performances.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This disclosure is directed to a cymbal mounting arrangement including a cymbal rod having a threaded distal end for receiving and supporting a cymbal thereover, an improvement including a quick-release locking device for retaining the cymbal on the rod. The locking device includes an elongated body having a longitudinal bore formed therethrough sized for close slidable engagement over the distal end of the cymbal rod. The locking device also includes a spring biased release arm pivotally connected within a cavity formed into the side of the body about a transverse pivot axis. The release arm is configured having thread engaging teeth at a proximal end thereof which biasingly engage against a limited number of threads of the distal end of the cymbal rod. An upper distal end of the release arm, when pivoted toward said body, releases the teeth from engagement with the threads of the distal end of the cymbal rod, allowing the locking device to be repositioned along the distal end of the cymbal rod or removed therefrom.

It is therefore an object of this invention to provide a quick release locking device for a cymbal mounting arrangement which substantially reduces the time for cymbal interchange during and between musical performances.

Still another object of this invention is to provide an economical, easy-to-use unique quick release locking device for retaining a cymbal on the threaded distal end of a cymbal rod of a cymbal mounting arrangement.

Yet another object of this invention is to provide a quick release locking device for retaining a cymbal onto the distal threaded end of a cymbal rod utilizing component shapes and cavity shapes required to more easily and economically manufacture this device.

And still another object of this invention is to provide a quick release locking device for retaining a cymbal onto the distal threaded end of a cymbal rod which may be utilized one handedly for the quick interchangeability of cymbals during and in between musical performances.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference of the drawings and by study of the following descriptions.

BRIEF DESCRIPTION OF THE SEVERAL VIEWS OF THE DRAWING(S)

FIG. 1 is a perspective view of one embodiment of the invention shown releasably attached onto the threaded distal end of a cymbal rod of a cymbal mounting arrangement.

FIG. 2 is an enlarged side elevation section view of a portion of FIG. 1.

Figure 3:
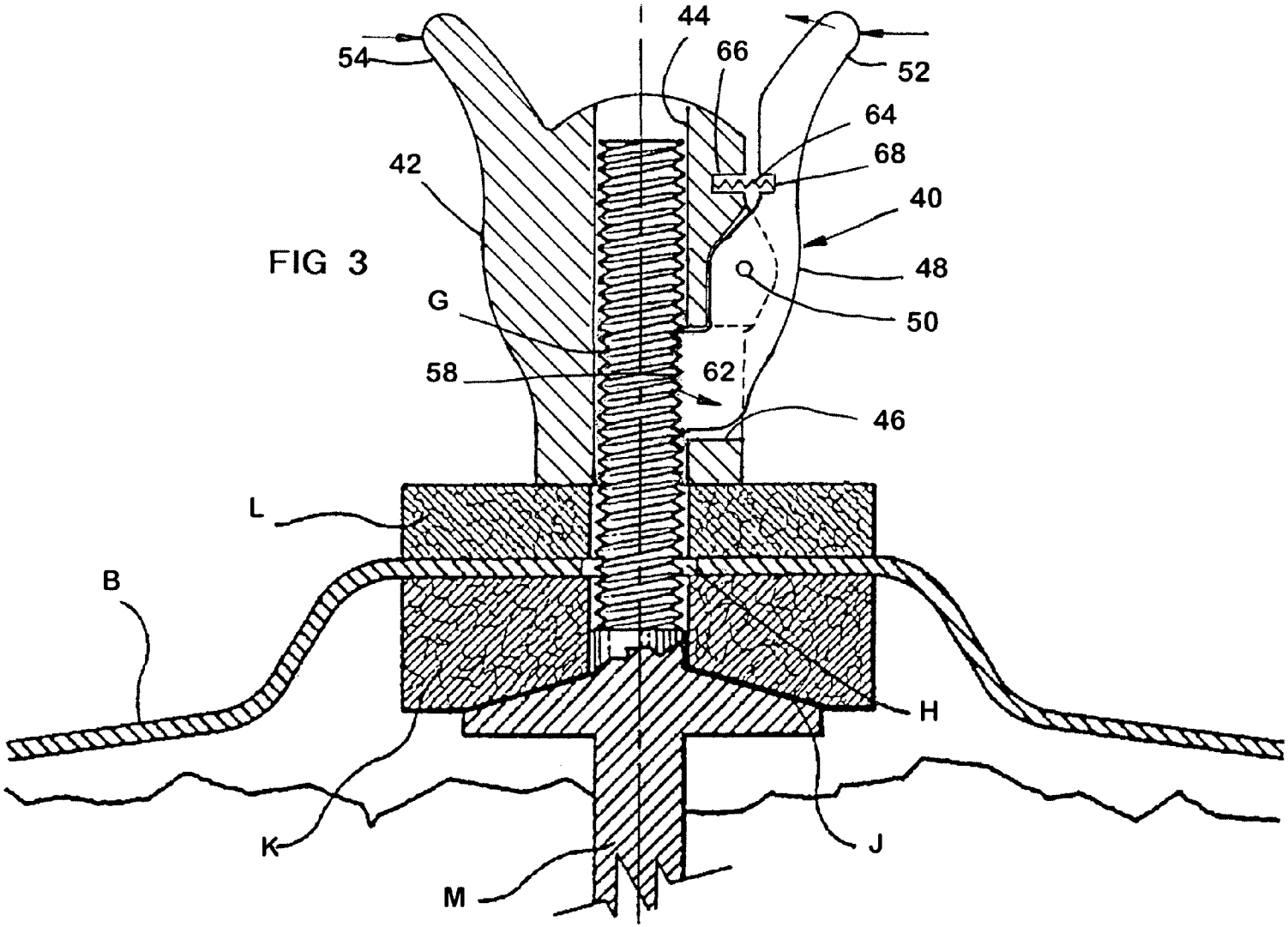
FIG. 3 is a side elevation section view of another embodiment of the invention attached atop the cymbal mounting arrangement of FIG. 1.

Exemplary embodiments are illustrated in reference figures of the drawings. It is intended that the embodiments and figures disclosed herein are to be considered to be illustrative rather than limiting.

DETAILED DESCRIPTION OF THE INVENTION

Referring now to the drawings, and firstly to FIGS. 1 and 2, a conventional cymbal mounting arrangement is shown generally at numeral A and includes a conventional cymbal B held on an elongated angularly adjustable threaded distal end G of a cymbal rod held on a universal fitting F connected at an upper end of an elongated support rod E. The lower end of the support rod E is clampingly engaged within a, musical stand D having a multi-legged base C attached at a lower portion thereof which is supporting the entire arrangement A atop a floor.

As best seen in FIG. 2, the center of the cymbal B includes a mounting hole H through which the distal end of the threaded cymbal rod G is inserted. Felt support washers K and L are positioned on either side of the center of the cymbal B, the lower felt washer K being supported on the upper support surface J of anvil M. After the prior art components of the cymbal and cymbal mounting arrangement shown in FIG. 2 are assembled as shown, a quick release locking device 10 is slid downwardly in the direction of the arrows over the exposed threaded distal end G of the cymbal rod.

This locking device 10 includes an elongated body 12 tapering toward an upper distal end thereof and having a longitudinally extending bore 14 formed centrally therethrough which closely slidably fits over the threaded end G. A release arm 18 is positioned within a cavity 16 also in the form of a cylindrical bore oriented diagonally through the side wall of the body 12 and extending inwardly to the longitudinal bore 14. A release arm 18 is pivotally connected within the cavity 16 by a crosspin 20 which is secured within a mating drilled hole formed through the body 12 about a transverse axis oriented orthogonally to the longitudinal axis of bore 14. The release arm 18 includes a proximal end 22 having transversely extending teeth which are configured to mate within the threads formed onto the threaded end G.

A compression spring 26 is positioned between a mating cavity 28 formed into the side wall of the body 12 and a cavity 30 formed into the inner edge of exposed portion of the release arm 18. This compression spring 26 maintains a biasing pressure between the proximal end 22 and the threaded distal end G when the locking device 10 has been positioned downwardly in the direction of the arrows over the distal threaded end G and against the upper surface of felt pad L. The release arm 18 is manually pivotable against the spring pressure from compression spring 26 in the direction of arrow 34 which causes a proximal end 22 to move in the direction of 36, providing ample clearance between the proximal end 22 and the threaded distal end G for installation, removal, and readjustment of the locking device 10 over the threaded distal end G. Once hand pressure between the surface 32 of body 12 and the distal upper end 24 of release arm is released, the proximal end 22 and the transverse teeth formed thereon will again engage into a portion of the threads formed onto the threaded distal end G to releasably secure the locking device 10 in place.

Referring now to FIG. 3, another embodiment of the invention is there shown generally at numeral 40 in conjunction with the same cymbal mounting arrangement A previously described. In this embodiment 40, the body 42 includes a longitudinal bore 44 which closely slidably engages over the threaded distal end G. A transverse bore 46 is formed into the lower side portion of the body 42 for receiving a proximal end 58 of a release arm 48. The proximal end 58 includes transverse teeth which retainingly mesh and engage into the threaded end G when the release arm 48 is in the at-rest position thus preventing relative longitudinal movement therebetween. The release arm 48 is held for pivotal movement about a transverse crosspin 50 passing through the body 42 and a coaxial hole formed into the arm 48 as shown. A compression spring 64 fitted in and acting between cavity 66 in body 42 and cavity 68 formed into the side edge of release arm 48 acts to biasingly hold the release arm 48 in this at-rest position.

When the distal end 52 of the release arm 48 is manually squeezed in the direction of the arrow by finger pressure toward an upwardly extending ear 54 upwardly and outwardly extending as a portion of the body 42, pivotal movement of the release arm 48 in the direction of arrows 60 at distal end 52 and 62 at proximal end 58 occurs. This releases the transverse teeth of the proximal end 58 from engagement with the threads formed into the threaded end G for vertical adjustment, installation and removal of the locking device 40, with respect to the threaded end G.

Figure 4:
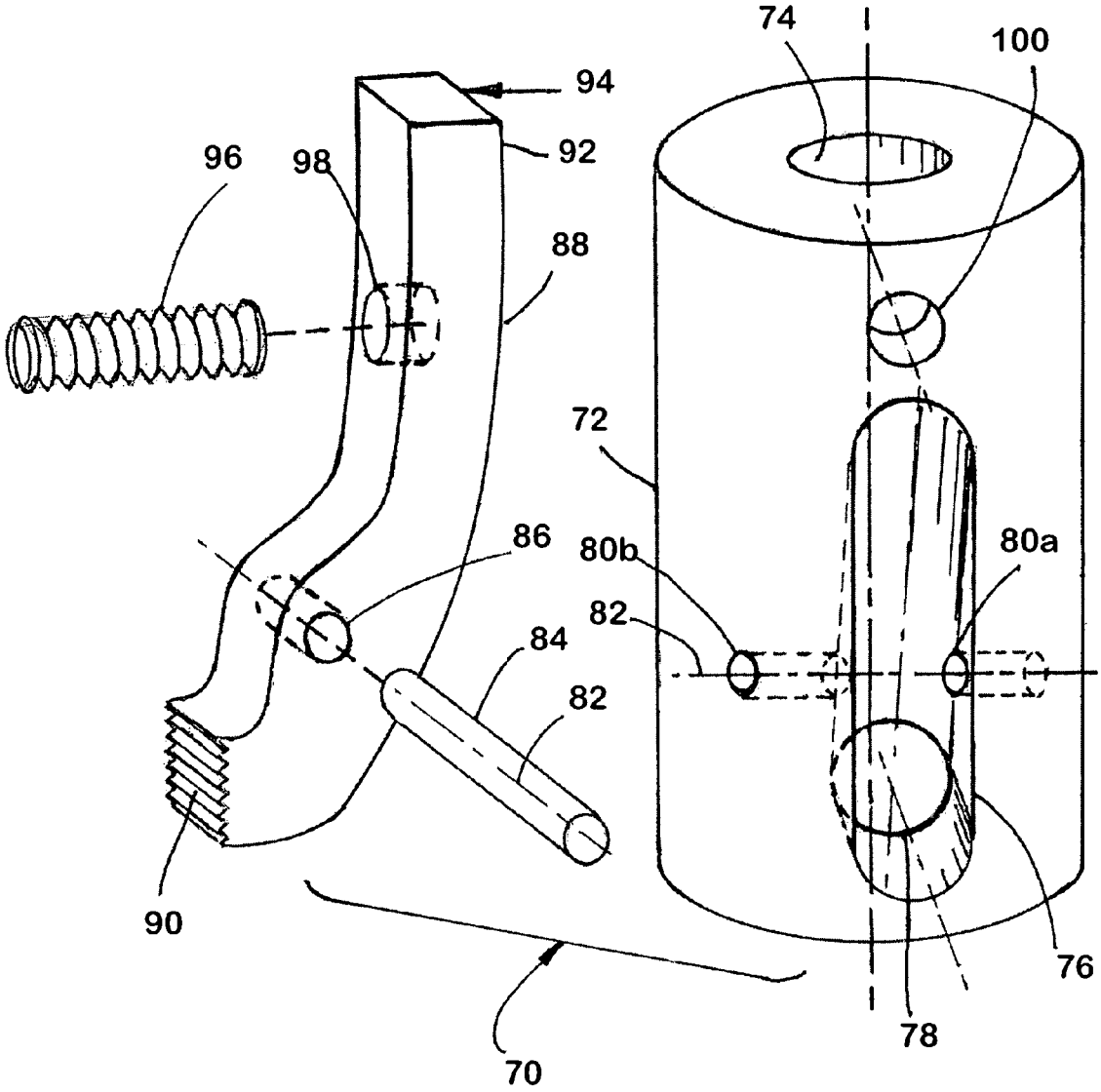
FIG. 4 is an exploded perspective view of yet another embodiment of the invention.

Referring now to FIG. 4, a more economical and simply manufactured embodiment is there shown generally at numeral 70. This embodiment 70 includes an elongated cylindrical body 72 having a central longitudinal bore 74 formed therethrough which, again, closely slidably engages over the threaded distal end G of the cymbal mounting arrangement A as previously described. The body 72 also includes a cavity 76 formed into the side thereof comprising a transverse radially inwardly extending first cylindrical portion 78 of cavity 76 which extends radially into and in communication with the longitudinal bore 74. This cavity 76 also includes a diagonal bore extending along the length of the body 72 and is oriented at an acute angle with respect to the axis of bore 74. A two-part transverse bore 80*a* and 80*b* extends transversely through the body 72 on either side of the cavity 76.

An elongated release arm 88 includes a proximal end 90 having transverse teeth formed thereon and a distal end 92. The proximal end 90 is positioned within the first cylindrical portion 78 of cavity 76 and is held there for pivotal movement about axis 82 by crosspin 84 passing through bore 86 and bores 80*a* and 80*b*.

A compression spring 96 is positioned within cavities 100 and 98 of the body 72 and release arm 88, respectively, to hold the proximal end 90 inwardly against the threads of the threaded end G as previously described in FIGS. 2 and 3. The distal end 92 of the release arm 88 extends outwardly of the cavity 76 and, when manually pressed in the direction of arrow 94, will pivot inwardly toward the body 72 about axis 82 disengaging the proximal end 90 from the threaded end G for installation, removal and vertical repositioning of the locking device 70 over the threaded end G.

While a number of exemplary aspects and embodiments have been discussed above, those of skill in the art will recognize certain modifications, permeations and additions and subcombinations thereof. It is therefore intended that the following appended claims and claims hereinafter introduced are interpreted to include all such modifications, permeations, additions and subcombinations that are within their true spirit and scope.

The invention claimed is:

1. In a cymbal mounting arrangement including a cymbal rod having a threaded distal end for receiving and supporting a cymbal thereover, the improvement comprising:

a quick-release locking device for retaining the cymbal on the rod, said locking device including an elongated body having a longitudinal bore formed therethrough sized for slidable engagement over the distal end of the cymbal rod;

said locking device also including a spring biased release arm pivotally connected within a cavity formed into said body about a transverse pivot axis and configured having thread engaging teeth at one end thereof which biasingly engage against a limited number of threads of the distal end of the cymbal rod;

an upper distal end of said release arm, when pivoted toward said body, releasing said teeth from engagement with the threads of the distal end of the cymbal rod and allowing said locking device to be repositioned along the distal end of the cymbal rod or removed therefrom.

2. In a cymbal mounting arrangement including a cymbal rod having a threaded distal end for receiving and supporting a cymbal thereover, the improvement comprising:

a quick-release locking device for retaining the cymbal on the rod, said locking device including an elongated body tapering toward a distal end thereof and having a longitudinal bore formed therethrough sized for close slidable engagement over the distal end of the cymbal rod;

an elongated cylindrical cavity formed into a side wall of said body at an acute angle to, and communicating with, said bore;

said locking device also including a spring biased release arm pivotally connected within said cavity about a pivot axis transverse to said cavity, a proximal end of said release arm positioned within said cavity configured having thread engaging teeth thereon which biasingly engage through a proximal end of said cavity against a limited number of threads of the distal end of the cymbal rod;

an upper distal end of said release arm being positioned outside of said cavity, when pivoted toward said body, releasing said teeth from engagement with the threads of the distal end of the cymbal rod and allowing said locking device to be repositioned along the distal end of the cymbal rod or removed therefrom.

3. In a cymbal mounting arrangement including a cymbal rod having a threaded distal end for receiving and supporting a cymbal thereover, the improvement consisting essentially of:

a quick-release locking device for retaining the cymbal on the rod, said locking device including an elongated substantially cylindrical body having a longitudinal bore formed therethrough sized for slidable engagement over the distal end of the cymbal rod;

an elongated cavity formed into a side wall of said body consisting of a first cylindrical portion thereof extending radially into said bore and having a second cylindrical portion oriented at an acute angle to said bore;

said locking device also having a spring biased release arm pivotally connected within said cavity formed into said body about a pivot axis oriented transversely to said cavity, a proximal end of said release arm configured having thread engaging teeth at one end thereon which biasingly engages through said cylindrical portion of cavity against a limited number of threads of the distal end of the cymbal rod;

an upper distal end of said release arm extending outside said cavity and along a distal portion of said body which, when pivoted toward said body, releasing said teeth from engagement with the threads of the distal end of the cymbal rod and allowing said locking device to be repositioned along the distal end of the cymbal rod or removed therefrom.

* * * * *